US005394804A

United States Patent [19]

Cauchetier

[11] Patent Number: 5,394,804

[45] Date of Patent: Mar. 7, 1995

[54] EXPLOSIVE DEVICE WITH A HOLLOW CHARGE, DESIGNED FOR PENETRATING ARMOR PROTECTED BY ACTIVE PRIMARY ARMOR

[75] Inventor: Jean Cauchetier, Paris, France

[73] Assignee: Thomson-Brandt Armements, La Ferte St. Aubin, France

[21] Appl. No.: 95,687

[22] Filed: Jul. 21, 1993

Related U.S. Application Data

[63] Continuation of Ser. No. 854,293, Mar. 19, 1992, abandoned.

[51] Int. Cl.[6] ..... F42B 12/18

[52] U.S. Cl. ..... 102/476; 102/308

[58] Field of Search ..... 102/306–310, 102/476

[56] References Cited

U.S. PATENT DOCUMENTS

| | | | |
|---|---|---|---|
| 2,984,307 | 5/1961 | Barnes | 102/308 |
| 3,215,074 | 11/1965 | Robinson, Jr. et al. | 102/308 |
| 3,416,449 | 12/1968 | Brothers | 102/476 |
| 3,750,582 | 8/1973 | Kintish et al. | 102/476 |
| 4,004,515 | 1/1977 | Mallory et al. | 102/476 |
| 4,359,943 | 11/1982 | Majerus | 102/309 |
| 4,982,665 | 1/1991 | Sewell et al. | 102/306 |

FOREIGN PATENT DOCUMENTS

| | | | |
|---|---|---|---|
| 252385 | 6/1987 | European Pat. Off. . | |
| 1161445 | 8/1958 | France | 102/308 |
| 1273684 | 9/1961 | France . | |
| 2410243 | 6/1979 | France | 102/476 |
| 2583156 | 12/1986 | France . | |
| 645611 | 11/1950 | United Kingdom . | |
| 2039008 | 7/1980 | United Kingdom | 102/476 |

*Primary Examiner*—Harold J. Tudor
*Attorney, Agent, or Firm*—Roland Plottel

[57] ABSTRACT

An explosive device with a hollow charge of the type including a main warhead with a wave shaper and a primary warhead for the penetration of active primary armor. The primary warhead comprises a hollow charge provided at the apex of the main warhead and separated from the latter by wave transmitting means in the form of a third hollow charge placed inverted relative to the other two hollow charges, the primary warhead also acting as a wave shaper for the main warhead.

9 Claims, 1 Drawing Sheet

EXPLOSIVE DEVICE WITH A HOLLOW CHARGE, DESIGNED FOR PENETRATING ARMOR PROTECTED BY ACTIVE PRIMARY ARMOR

This application is a continuation of application Ser. No. 07/854.293, Mar. 19, 1992, now abandoned.

BACKGROUND OF THE INVENTION

The present invention concerns an explosive device with a hollow charge designed for penetrating armor protected by active primary armor.

It is stated, as a reminder, that a hollow charge is basically made up of a rotationally symmetric explosive charge, provided with an open cavity covered by a metallic liner, and a priming device also having rotational symmetry. When detonated by the priming device, the metallic liner of the cavity is projected onto the rotational axis of the charge producing a jet of molten metal, which travels at very high speed along this axis, and a metal slug, travelling more slowly along the same axis, in the same direction as the preceding jet or in the opposite direction.

It is also reminded that, active primary armor is generally an auxiliary armor positioned in front of a conventional armor, referred to as the main armor; this auxiliary armor comprises two plates, usually made of steel a few millimetres thick with a relatively thin layer of explosive sandwiched between them. The primary armor may be multi-layered, that is, it may include several such sandwiches. The primary armor is provided so that when it is hit by a projectile, the head of the latter detonates the explosive layer on penetrating it. The explosion then projects the steel plates towards the projectile, perturbing it and reducing its lethality. In particular, in the case of a hollow charge projectile, the steel plates of the primary armor interfere with the jet of the hollow charge to such an extent that it loses most of its penetrating power against the main armor.

Such active primary armors are frequently used for the protection of armored vehicles, such as combat tanks.

The problem which faces designers of anti-tank munitions is therefore the following: in order to penetrate the main armor, it is preferable to use a very powerful hollow charge capable of penetrating the main armor which is usually very thick, yet, as stated above, hollow charges are particularly vulnerable to the action of active primary armor.

Different solutions are known for resolving this problem.

A first solution consists of greatly increasing the nominal penetrating power of the hollow charge so that its residual penetrating power (after interference by the primary armor) is sufficient. This process is simple but very expensive in terms of hollow charge calibres.

A second solution is the two-stage hollow charge (often referred to as a tandem warhead). The function of the charge which operates first, referred to as the primary warhead, is to neutralize the primary armor:

- either by initiating it soon enough before the detonation of the second, or main, warhead, and thus facilitating the elimination of the primary armor plates before the arrival of the jet of the main warhead;
- or by penetrating it without igniting it.

In the first case, adjustment of the process is difficult, in particular regarding the delay between the detonation of the two charges, and the implementation of this adjustment complicates the structure of the munitions, in particular those which, designed to be fired from cannons, must withstand very high acceleration. A solution corresponding to the second case is described notably in French patent application no. 2 583 156, which describes means of reducing the effect of the primary warhead. This embodiment, like the preceding one, has the disadvantage of increasing the bulk of the explosive device.

Furthermore, in order to improve the performance of a hollow charge, a known method consists of providing, between the priming device detonator and the explosive charge, a wave shaper, also known as a screen, whose function is to deflect the detonation wave and make it toric. This makes it possible, by varying the waveform and the shape of the cavity, to increase the velocity of the pentrating jet produced by the hollow charge, the explosive yield of the charge, etc.. The form of the screen is determined so that the detonation wave is deflected without substantial power loss, and so as to obtain the desired angle of incidence of this wave on the liner of the cavity. This leads to bulky screens whose length may be one third or one quarter of the length of the explosive charge, which again leads to an increase in bulk of the hollow charge and reduces its efficiency.

SUMMARY OF THE INVENTION

The purpose of the present invention is to reduce the longitudinal size of an explosive device with a hollow charge, of the type including a main warhead with a wave shaper and a primary warhead for the penetration of an active primary armor.

For this purpose, the primary warhead is a hollow charge placed at the apex of the main hollow charge and separated from the latter by wave transmission means, preferably comprising a third hollow charge inverted relative to the other two, the primary warhead also acting as a wave shaper for the main warhead.

BRIEF DESCRIPTION OF THE DRAWING

Other purposes, particular characteristics and results of the invention will become apparent from the following description, given as an example, but not limitative, and illustrated by the drawings, which represents in cross-section an embodiment of the explosive device with a hollow charge according to the invention in which.

DESCRIPTION OF THE PREFERRED EMBODIMENT

Figure 1:
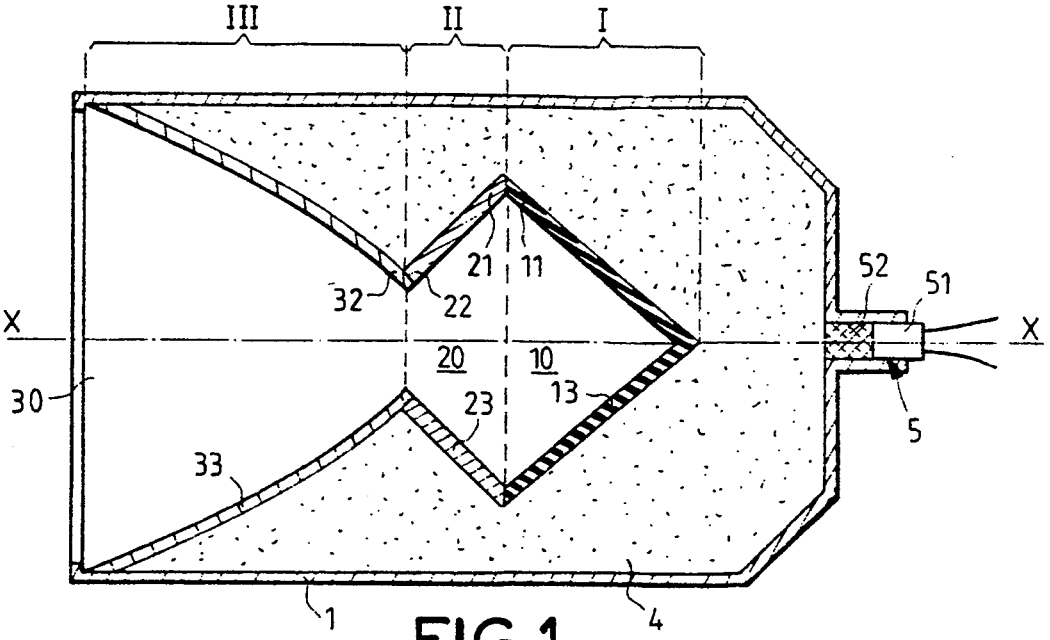
FIG. 1 is a schematic cross-sectional view of an explosive device according to the invention.

The drawing represents an explosive device including an explosive charge 4 contained in a casing 1, and which is provided with an open cavity including three sections, marked 10, 20 and 30 from the explosive charge towards the opening respectively; the cavity is covered by a liner in three sections marked 13, 23, and 33 respectively. At the rear of the casing, which is at the opposite end from the opening of the cavity, a priming device 5 is provided, including, for example, a detonator 51 and an igniter charge 52, primed by the detonator 51 and having the function of detonating the charge 4. The assembly has rotational symmetry about a longitudinal axis XX.

Figure 2:
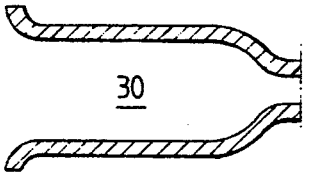
FIG. 2 is a schematic view of the cavity of the main warhead section showing an alternative to the embodiment of FIG. 1.
Figure 3:
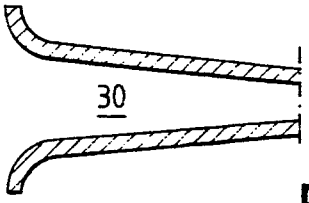
FIG. 3 is a further alternative embodiment to that shown in FIG. 2.

The device therefore includes three sections, namely, starting from the rear of the device:

- a section I, forming the primary warhead of a tandem-type warhead as described above. This primary warhead is a hollow charge, formed by cavity 10 open towards the front, for example in the approximate form of a cone, by section 13 of the liner and by the part of the explosive charge 4 surrounding it;
- a second section II constituting a wave transmitter, formed by cavity 20 which is open at both ends but is more open at the rear of the device than at the front (for example in the form of a truncated cone), by section 23 of the liner and by the part of the explosive charge surrounding it;
- a section II forming the main warhead of the tandem charge; it comprises a hollow charge formed by cavity 30, open at the front and not completely closed at its apex (for example in the approximate form of a cone, trumpet or tulip as shown in FIG. 2), by section 33 of the liner and by the part of the explosive charge 4 surrounding it.

When the detonator is triggered, it creates a detonation wave, by means of the igniter charge 52, in the explosive charge 4. The detonation wave is propagated in the primary warhead section (I) of the device, causing a very rapid jet and a slower slug to be formed from liner 13, and propagated on the axis XX. As stated earlier, the jet is intended to penetrate an active primary armor without igniting it.

Penetration without ignition is achieved by restricting the energy per unit area transmitted by the jet to the explosive of the primary armor, the energy of the jet depending mainly on the nature and weight of the liner and on the speed of the jet. For this reason, a material of low density is used for the liner, for example a plastic Nylon type material, along with a hollow charge designed to give the jet a relatively high velocity, so that there is no risk of collision between the jet of the primary warhead and that of the main warhead.

The form of the detonation wave arriving at base 11 of liner 13 is the same as one formed by a conventional wave shaper, this function being performed by the primary warhead I.

The wave transmitter II is designed to conduct the detonation wave to the apex 32 of the main warhead III. This transmitter functions like a hollow charge but with its priming device inverted, that is, it operates from its base 21. From liner 23, a jet is therefore formed, travelling on axis XX towards the rear of the device, a jet which is lost, and a slug whose effect is to close the apex 32 of the main hollow charge III. It must be noted that liner 23 is not essential; in fact, the closure of apex 32 itself is, in principle, not essential for the functioning of the main warhead; it does, however, have the advantage of opposing the passage of the slug of the primary warhead I, which, itself, would be liable to interfere with the formation of the jet of the main warhead. For this purpose, liner 23 may be made of metallic material, for example soft steel or copper. It must also be noted that the cavity 20 of the wave transmitter is represented in tapered form but that it may have other forms, for example that of a tulip or a trumpet; it can also have a larger or smaller angle at the apex, or even a cylindrical form, the angle depending on the diameters chosen for the base 11 of the primary warhead and the apex 32 of the main warhead.

The detonation wave then reaches the main hollow charge III, which then functions like a hollow charge equipped with a wave shaper. The liner 33 may conventionally be metallic, for example copper.

The explosive device described above therefore offers the advantages of a tandem-type structure and a hollow charge including a wave shaper, the entire assembly having reduced size, Moreover, the fact that the primary warhead penetrates an active primary armor without initiating it means that the action of the main warhead does not have to be delayed. The device according to the invention offers the following additional advantages:

- elimination of possible inter-charge screens, as only a single explosive charge 4 is used;
- elimination of the priming device of the primary warhead; according to the invention, a single device 5 assures the initiation of the whole assembly;
- elimination of the risks of destruction of the main warhead before it functions; in fact, according to the invention, there is no possible back-firing of the primary warhead towards the main warhead;
- large calibre of the primary warhead (equal to that of the main warhead);
- reduction of the influence of the munition's sideslipping on the target, by reducing the overall functioning delay.

What is claimed is:

1. Explosive device with a hollow charge including, in a casing: a continuous explosive charge, rotationally symmetric about a longitudinal axis, an open cavity being provided in the charge, a priming means for initiating said explosive charge, said cavity comprising three sections, respectively: a first section with a layer on the surface of the cavity forming a liner, this section forming, with the corresponding section of the explosive charge, a main warhead; a second section with a layer on the surface of the cavity forming a liner, this section forming, with the corresponding section of the explosive charge, a primary warhead, located at a same end as the priming means, said liner of the primary warhead section being a material of low density; a third section forming, with the corresponding section of the explosive charge, a wave transmitter, located between said first and second sections, the primary warhead section being initiated first and also acting as a wave shaper for the main warhead section, and the wave transmitter section transmits the detonation wave from the primary warhead section to the main warhead section, and said liner of the primary section upon initiation of said explosive charge forming a jet rapidly travelling along said axis, said jet of said liner having a weight and a speed so that it penetrates an active primary armor without ignition of said active primary armor.

2. Device according to claim 1, wherein the liner of the main warhead section is metallic.

3. Device according to claim 1, wherein the low density material is a plastic material.

4. Device according to claim 1, wherein the cavity of the wave transmitter section is covered by a layer forming a liner.

5. Device according to claim 4, wherein the liner of the wave transmitter section is metallic.

6. Device according to claim 1, wherein the cavity of the primary warhead section has a substantially conical form, the apex of the cone being situated towards the priming means.

7. Device according to claim 1, wherein the cavity of the wave transmitter section has a substantially frustoconical form, with the apex of the corresponding cone being situated towards the opposite end from the priming means.

8. Device according to claim 1, wherein the cavity of main warhead section is substantially in the form selected from the group consisting of a cone, trumpet or tulip, open at an opposite end from the priming means.

9. Device according to claim 3, wherein said low density plastic material is nylon.

* * * * *